US005422709A

United States Patent [19]

Minagawa et al.

[11] Patent Number: 5,422,709

[45] Date of Patent: Jun. 6, 1995

[54] ELECTRODE WIRE GRID FOR DEVELOPER UNIT

[75] Inventors: Gary A. Minagawa, Fairport; Daniel M. Bray, Rochester, both of N.Y.

[73] Assignee: Xerox Corporation, Stamford, Conn.

[21] Appl. No.: 122,674

[22] Filed: Sep. 17, 1993

[51] Int. Cl.[6] ..... G03G 15/08

[52] U.S. Cl. ..... 355/247; 118/654; 355/262

[58] Field of Search ..... 355/247, 248, 249, 261, 355/262, 263, 264, 245, 259; 118/654

[56] References Cited

U.S. PATENT DOCUMENTS

| | | | |
|---|---|---|---|
| 3,147,147 | 9/1964 | Carlson | 355/262 X |
| 3,998,185 | 12/1976 | Weiler | 355/259 X |
| 4,697,914 | 10/1987 | Hauser | 355/245 X |
| 4,868,600 | 9/1989 | Hays et al. | 355/259 |
| 4,984,019 | 1/1991 | Folkins | 355/215 |
| 5,196,890 | 3/1993 | Nakayama et al. | 355/259 |
| 5,289,240 | 2/1994 | Wayman | 355/259 |

*Primary Examiner*—A. T. Grimley
*Assistant Examiner*—Nestor R. Ramirez
*Attorney, Agent, or Firm*—H. Fleischer; J. E. Beck; R. Zibelli

[57] ABSTRACT

An apparatus in which a donor roll advances toner to an electrostatic latent image recorded on a photoconductive member. A plurality of electrode wires are positioned in the space between the donor roll and the photoconductive member. The electrode wires extend in a transverse direction relative to the longitudinal axis of the donor roll. The electrode wires are electrically biased to detach the toner from the donor roll so as to form a toner cloud in the space between the electrode wires and photoconductive members. Detached toner from the toner cloud develops the latent image. Electrode wires contact a portion of the surface of the donor roll. As the donor roll rotates, friction between the electrode wires and donor roll causes trapped debris to move away from the toner powder cloud region so as to minimize contamination produced streaks on the developed image.

12 Claims, 3 Drawing Sheets

ELECTRODE WIRE GRID FOR DEVELOPER UNIT

This invention relates generally to an electrophotographic printing machine, and more particularly concerns positioning electrode wires used in a scavengeless developer unit.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member. After the electrostatic latent image is recorded on the photoconductive member, the latent image is developed by bringing a developer material into contact therewith. Two component and single component developer materials are commonly used. A typical two-component developer material has magnetic carrier granules with toner particles adhering triobelectrically thereto. A single component developer material typically comprises toner particles. Toner particles are attracted to the latent image forming a toner powder image on the photoconductive member. The toner powder image is subsequently transferred to a copy sheet. Finally, the toner powder image is heated to permanently fuse it to the copy sheet in image configuration.

One type of single component development system is a scavengeless development system that uses a donor roll for transporting charged toner to a development zone. A plurality of electrode wires are closely spaced to the donor roll in the development zone. An AC voltage is applied to the wires forming a toner cloud in the development zone. The electrostatic fields generated by the latent image attract toner from the toner cloud to develop the latent image. A hybrid scavengeless development system employs a magnetic brush developer roller for transporting carrier having toner adhering triboelectrically thereto. The donor roll and magnetic roller are electrically biased relative to one another. Toner is attracted to the donor roll from the magnetic roller. The donor roll transports the charged toner to a development zone. The electrically biased electrode wires detach the toner from the donor roll forming a toner powder cloud in the development zone, and the latent image attracts the toner particles thereto. In this way, the latent image recorded on the photoconductive member is developed with the toner particles. It has been found that streaks are formed in the developed latent image when debris is trapped in the electrode wires. Heretofor, the electrode wires have been positioned substantially perpendicular to the process direction, i.e. substantially parallel to the longitudinal axis of the donor roll. Various types of development systems have hereinbefore been used incorporating electrode wires as illustrated by the following disclosures, which may be relevant to certain aspects of the present invention:

U.S. Pat. No. 4,868,600 Patentee: Hays et al. Issued: Sep. 19, 1989

U.S. Pat. No. 4,984,019 Patentee: Folkins Issued: Jan. 8, 1991

The relevant portions of the foregoing patents may be briefly summarized as follows:

U.S. Pat. No. 4,868,600 describes an apparatus wherein a magnetic roll transports two component developers to a transfer region where toner from the magnetic roll is transferred to a donor roll. The donor roll transports the toner to a region opposed from a surface on which a latent image is recorded. A pair of electrode wires are positioned in the space between the surface and the donor roll and are electrically biased to detach toner from the donor roll to form a toner cloud. Detach toner from the cloud develops the latent image.

U.S. Pat. No. 4,984,019 discloses a developer unit having a donor roll with electrode wires disposed adjacent thereto in a development zone. A magnetic roller transports developer material to the donor roll. Toner particles are attracted from the magnetic roller to the donor roller. When the developer unit is inactivated, the electrode wires are vibrated to remove contaminants therefrom.

In accordance with one aspect of the present invention, there is provided an apparatus for developing a latent image recorded on a surface. The apparatus includes a housing defining a chamber storing at least a supply of toner therein. A donor roll, disposed at least partially in the chamber of the housing and spaced from the surface, is adapted to rotate about a longitudinal axis to transport toner to a region opposed from the surface. An elongated electrode extending in a direction transverse to the longitudinal axis and positioned in the space between the surface and the donor roll is electrically biased to detach toner from the donor roll. This forms a toner powder cloud in the space between the electrode and the surface with detached toner from the toner cloud developing the latent image.

Pursuant to another aspect of the present invention, there is provided an electrophotographic printing machine of the type having a latent image developed on a photoconductive member and transferred to a copy sheet. The improvement includes a housing defining a chamber storing at least a supply of toner the rein. A donor roll, disposed at least partially in the chamber of the housing and spaced from the photoconductive member, is adapted to rotate about a longitudinal axis to transport toner to a region opposed from the photoconductive member. An elongated electrode extending in direction transverse to the longitudinal axis and positioned in the space between the photoconductive member and the donor roll is electrically biased to detach toner from the donor roll. This forms a toner powder cloud in the space between the electrode and the photoconductive member. Toner is detached from the toner cloud to develop the latent image recorded on the photoconductive member.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Inasmuch as the art of electrophotographic printing is well known, the various processing stations employed in the FIG. 4 printing machine will be shown hereinafter schematically and their operation described briefly with reference thereto.

Figure 4:
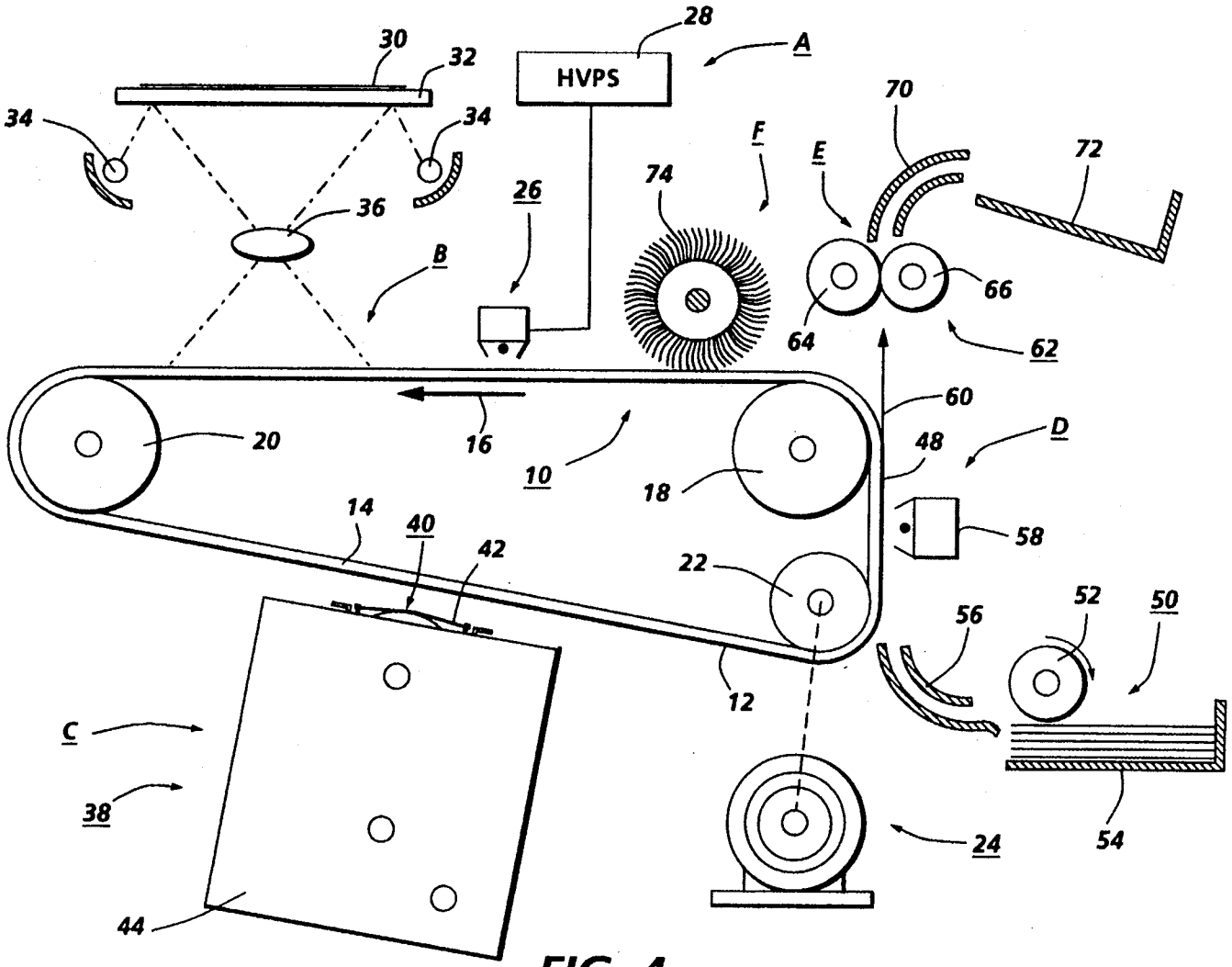
FIG. 4 is a schematic elevational view of an illustrative electrophotographic printing machine incorporating the FIG. 1 development apparatus therein.

Referring initially to FIG. 4, there is shown an illustrative electrophotographic printing machine incorporating the development apparatus of the present invention therein. The electrophotographic printing machine employs a belt 10 having a photoconductive surface 12 deposited on a conductive substrate 14. Preferably, photoconductive surface 12 is made from a selenium alloy. Conductive substrate 14 is made preferably from an aluminum alloy which is electrically grounded. Belt 10 moves in the direction of arrow 16 to advance successful portions of photoconductive surface 12 sequentially through the various processing stations disposed about the path of movement thereon. Belt 10 is entrained about stripping roller 18, tensioning roller 20 and drive roller 22. Drive roller 22 is mounted rotatably in engagement with belt 10. Motor 24 rotates roller 22 to advance belt 10 in the direction of arrow 16. Roller 22 is coupled to motor 24 by suitable means such as a drive belt. Belt 10 is maintained in tension by a pair of springs (not shown) resiliently urging tensioning roller 20 against belt 10 with the desired spring force. Stripping roller 18 and tensioning roller 20 are mounted to rotate freely.

Initially, a portion of belt 10 passes through charging station A. At charging station A, a corona generating device, indicated generally by the reference numeral 26, charges photoconductive surface 12 to a relatively high, substantially uniform potential. High voltage power supply 28 is coupled to corona generating device 26. Excitation of power supply 28 causes corona generating device 26 to charge photoconductive surface 12 of belt 10. After photoconductive surface 12 of belt 10 is charged, the charged portion thereof is advanced through exposure station B.

At exposure station B, an original document 30 is placed face down upon a transparent platen 32. Lamps 34 flash light rays onto original document 30. The light rays reflected from original document 30 are transmitted through lens 36 to form a light image thereof. Lens 36 focuses the light image onto the charged portion of photoconductive surface 12 to selectively dissipate the charge thereon. This records an electrostatic latent image on photoconductive surface 12 which corresponds to the informational areas contained within original document 30. One skilled in the art will appreciate that in lieu of a light lens system, a raster output scanner may be employed. The raster output scanner (ROS) uses a modulated laser light beam to selectively discharge the charged photoconductive surface 12 as to record the latent image thereon. In the event a printing system is being employed, the modulation of the ROS is controlled by an electronic subsystem coupled to a computer. Alternatively, in the event a digital copier is being used, a raster input scanner may scan an original document to convert the information contained therein to digital format which, in turn, is employed to control the ROS.

After the electrostatic latent image has been recorded on photoconductive surface 12, belt 10 advances the latent image to development station C. At development station C, a developer unit, indicated generally by the reference numeral 38, develops the latent image recorded on the photoconductive surface. Preferably, developer unit 38 includes donor roller 40 and electrode wires 42. Electrode wires 42 are electrically biased relative to donor roll 40 to detach toner therefrom so as to form a toner powder cloud in the gap between the donor roll and the photoconductive surface. The latent image attracts toner particles from the toner powder cloud forming a toner powder image thereon. Donor roller 40 is mounted, at least partially, in the chamber of developer housing 44. The chamber in developer housing 44 stores a supply of developer material. The developer material is two component developer material having at least carrier granules with toner particles adhering triboelectrically thereto. A magnetic roller disposed interiorly of the chamber of housing 44 conveys the developer material to the donor roller. The magnetic roller is electrically biased relative to the donor roller so that the toner particles are attracted from the magnetic roller to the donor roller. Developer unit 38 will be discussed hereinafter, in greater detail, with reference to FIGS. 1 through 3, inclusive.

With continued reference to FIG. 4, after the electrostatic latent image is developed, belt 10 advances the toner powder image to transfer station D. A copy sheet 48 is advanced to transfer station D by sheet feeding apparatus 50. Preferably, sheet feeding apparatus 50 includes a feed roll 52 contacting the uppermost sheet of stack 54. Feed roll 52 rotates to advance the uppermost sheet from stack 54 into chute 56. Chute 56 directs the advancing sheet of support material into contact with photoconductive surface 12 of belt 10 in a timed sequence so that the toner powder image developed thereon contacts the advancing sheet at transfer station D. Transfer station D includes a corona generating device 58 which sprays ions onto the backside of sheet 48. This attracts the toner powder image from photoconductive surface 12 to sheet 48. After transfer, sheet 48 continues to move in the direction of arrow 60 onto a conveyor (not shown) which advances sheet 48 to fusing station E.

Fusing station E includes a fuser assembly indicated generally by the reference numeral 62 which permanently affixes the transferred powder image to sheet 48. Fuser assembly 62 includes a heated fuser roller 64 and back-up roller 66. Sheet 48 passes between fuser roller 64 and back-up roller 66 with the toner powder image contacting fuser roller 64. In this manner, the toner powder image is permanently affixed to sheet 48. After fusing, sheet 48 advances through chute 70 to catch tray 72 for subsequent removal from the printing machine by the operator.

After the the copy sheet is separated from photoconductive surface 12 of belt 10, the residual toner particles adhering to photoconductive surface 12 are removed therefrom at cleaning station F. Cleaning station F includes a rotatably mounted fibrous brush 74 in contact with photoconductive surface 12. The particles are cleaned from photoconductive surface 12 by the rotation of brush 74 in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the developer unit of the present invention therein.

Figure 1:
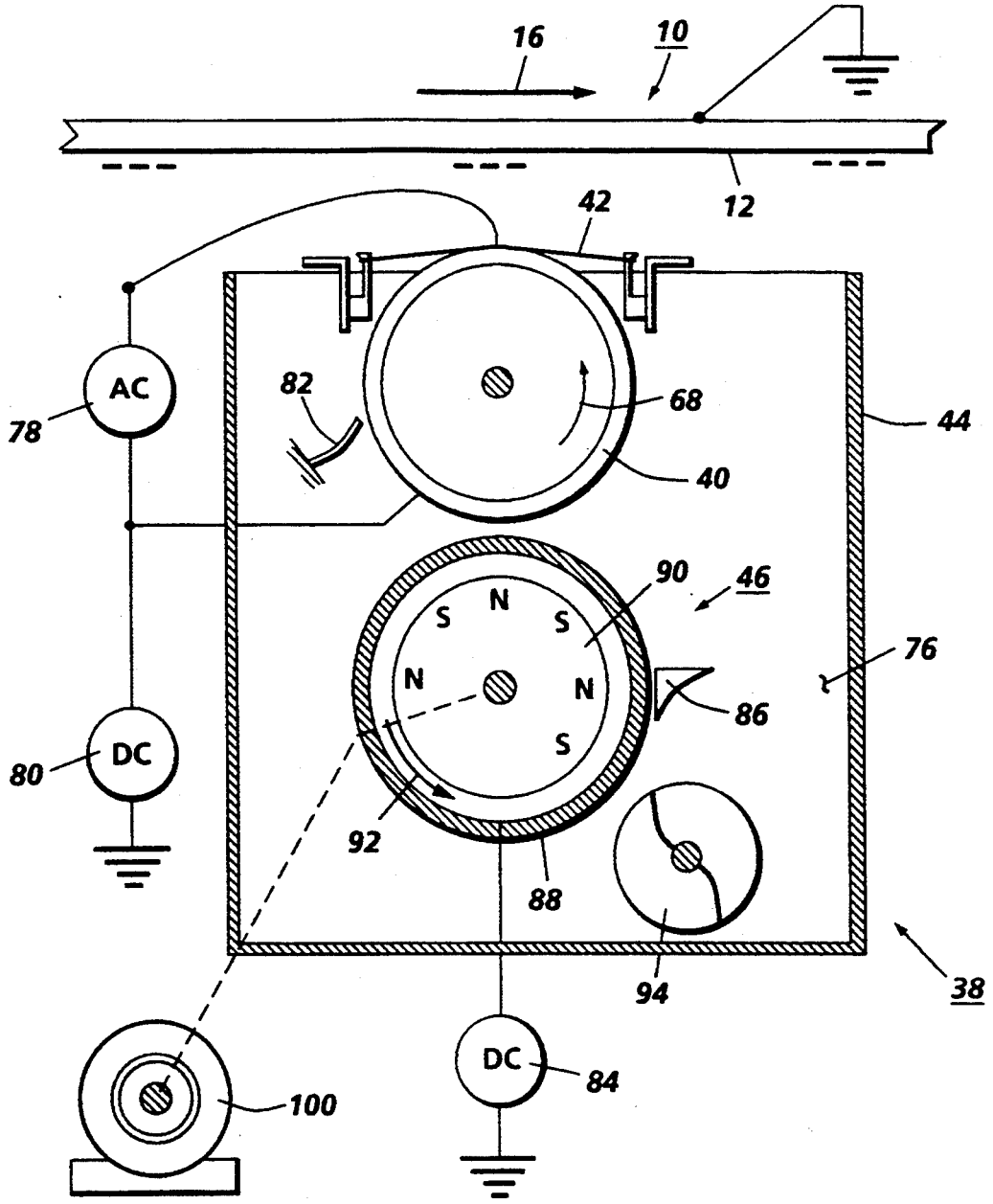
FIG. 1 is a schematic elevational view showing the development apparatus used in the FIG. 4 printing machine.

Referring now to FIG. 1, there is shown developer unit 38 in greater detail. As shown thereat, developer unit 38 includes a housing 44 defining a chamber 76 for storing a supply of developer material therein. Donor roller 40, electrode wires 42 and magnetic roller 46 are mounted in chamber 76 of housing 44. Donor roller 40 can be rotated in either the "with" or "against" direction relative to the direction of motion of belt 10. In FIG. 1, donor roll 40 is rotating in the direction of arrow 68. Similarly, the magnetic roller can be rotated in either the "with" or "against" direction relative to the direction of motion of belt 10. In FIG. 1, magnetic roller 46 is rotating in the direction of arrow 92. Donor roller 40 is preferably made from an anodized aluminum or ceramic coated aluminum.

Developer unit 38 also has electrode wires 42 which are located in the space between belt 10 and donor roll 40. A plurality of electrode wires are shown extending in a direction substantially transverse to the longitudinal axis of the donor roll. As shown more clearly in FIG. 2, electrode wires 42 form an acute angle with respect to the longitudinal axis of donor roll 40. The electrode wires are made from one or more thin (i.e. 50 to 100 micron diameter) stainless steal wires which are closely spaced and in contact with donor roll 40. The wires are maintained in tension. The extremities of the wires are supported so as to maintain the desired tension with the wires being slightly below or tangent to the surface of the donor roll.

As illustrated in FIG. 1, an alternating electrical bias is applied to the electrode wire by an AC voltage source 78. The applied AC voltage establishes an alternating electrostatic field between the wires and the donor roller which is effective in detaching toner from the donor roller and forming a toner powder cloud about the wires. The magnitude of the AC voltage is relatively low and in the order of 200 to 500 volts peak at a frequency ranging from about 3 KHZ to about 10 KHZ. A DC bias supply 80 which applies approximately 300 volts to donor roll 40 establishes an electrostatic field between photoconductive surface 12 of belt 10 and donor roll 40 for attracting the detached toner particles from the toner cloud surrounding the wires to the latent image recorded on the photoconductive member. A cleaning blade 82 strips all of the toner from donor roller 40 at development so that magnetic roller 46 meters fresh toner to a clean donor roll. Magnetic roller 46 meters a constant quantity of toner having a substantially constant charge onto donor roller 40. This insures that the donor roller provides a constant amount of toner having a substantially constant charge in the development gap. In lieu of using a cleaning blade, the combination of donor roller spacing, i.e. spacing between the donor roller and the magnetic roller, the compressed pile height of the developer material on the magnetic roller, and the magnetic properties of the magnetic roller, in conjunction with the use of a conductive, magnetic developer material achieves the deposition of a constant quantity of toner having a substantially constant charge on the donor roll. A DC bias supply 84 which applies approximately 100 volts to magnetic roller 46 establishes an electrostatic field between magnetic roller 46 and donor roller 40 which causes toner particles to be attracted from the magnetic roller to the donor roller. Metering blade 86 is positioned closely adjacent to magnetic roller 46 to maintain the compressed pile height of the developer material on magnetic roller 46 at the desired level. Magnetic roller 46 includes a non-magnetic tubular member 88 made preferably from aluminum and having the exterior circumferential surface roughened. An elongated magnetic 90 is positioned interiorly of and spaced from the tubular member. The magnetic is mounted stationarily. The tubular member rotates in the direction arrow 92 to advance the developer material adhering thereto into the nip defined by donor roller 40 and magnetic roller 46. Motor 100 drives non-magnetic tubular member 88 to rotate in the direction of arrow 92. Toner particles are attracted from the carrier granules on the magnetic roller to the donor roller.

With continued reference to FIG. 1, an auger, indicated generally by the reference numeral 94, is located in chamber 76 of housing 44. Auger 94 is mounted rotatably in chamber 76 to mix and transport developer material. The auger has blades extending spirally outwardly from the shaft. The blades are designed to advance the developer material in a axial direction substantially parallel to the longitudinal axis of the shaft.

As successive electrostatic latent images are developed, the toner particles within the developer material are depleted. A toner dispenser (not shown) stores a supply of toner particles. The toner dispenser is in communication with chamber 76 of housing 44. As the concentration of toner particles in the developer material is decreased, fresh toner particles are furnished to the developer material in the chamber from the toner dispenser. The auger in the chamber of the housing mixes the fresh toner particles with the remaining developer material so that the resultant developer material is substantially uniform with the concentration of toner particles being substantially optimized. In this way, a substantially constant amount of toner particles are in the chamber of the developer housing with the toner particles having a constant charge. The developer material in the chamber of the housing is magnetic and may be electrically conductive. By way of example, the carrier granules include a ferromagntic core having a thin layer of magnetite overcoated with a noncontinuous layer of resinous material. The toner particles are made from a resinous material, such as a vinyl polymer, mixed with a coloring material such as chromogen black. The developer material comprises from about 90% to about 99% by weight of carrier and from 10% to about 1% by weight of toner. However, one skilled in the art will recognize that any other suitable developer material may be used.

Figure 2:
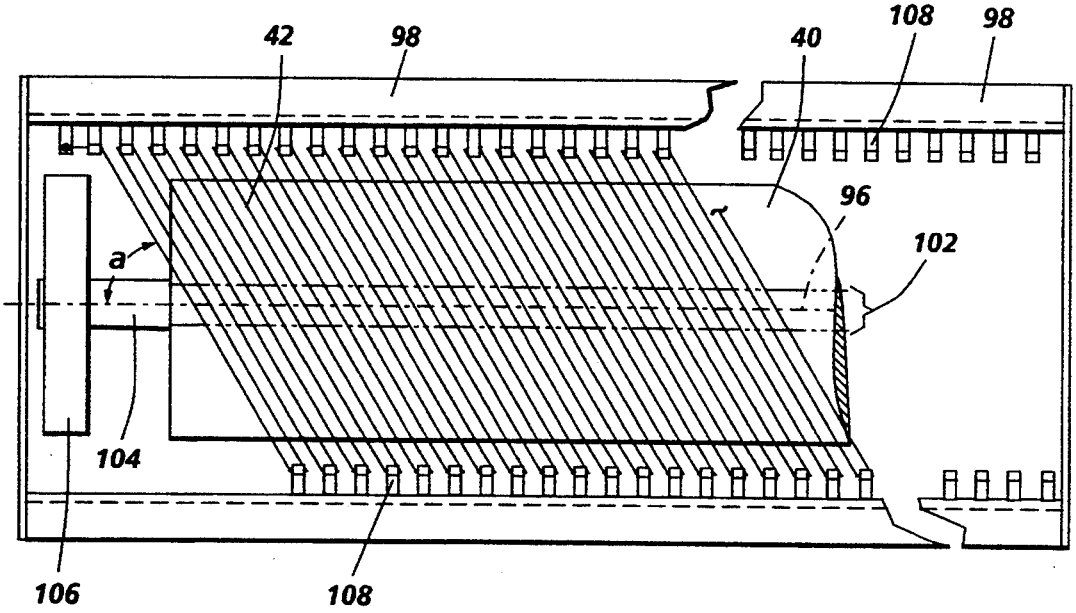
FIG. 2 is a plan view showing the orientation of the electrode wires relative to the longitudinal axis of the donor roll.

FIG. 2 depicts the electrode wire arrangement. As shown, electrode wires 42 are rigidly secured to frame 98 under a desired or preselected tension. Electrode wires 42 are positioned at a transverse angle with respect to the longitudinal axis 96 of donor roller 40. Electrode wires 42 form an acute angle, a, with respect to longitudinal axis 96. Donor roller 40 is adapted to rotate about longitudinal axis 96. Donor roller 40 includes a shaft 104 mounted in bearings in developer housing 44. As donor roller 40 rotates about longitudinal axis 96, electrode wires 42 contact the surface thereof in area 102. The friction between the donor roll and electrode wires drives any contamination trapped by the electrode wires from the region of the toner cloud. This minimizes the effect that debris may have on the formation of the latent image thus minimizing resultant copy streaks and imperfections caused by this debris. As shown, the electrode wires are relatively short and may be maintained at a low tension without producing strobing effects. An added advantage to the present invention is that the reduction in tension enhances the life of the electrode wires. A guide bearing 106 defines the spacing between the donor roll and the photoconductive belt 10. Guide bearing 106 contacts belt 10 providing sufficient clearance between both the donor roller 40 and the electrode wires therefrom. The plurality of electrode wires 42 extending in a transverse direction across the longitudinal axis of donor roller 40 are parallel and spaced from one another.

Figure 3:
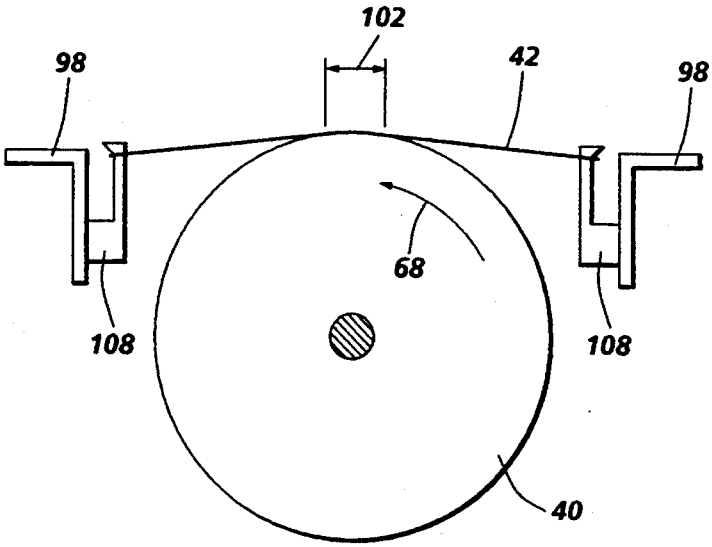
FIG. 3 is an elevational view showing the electrode wire contacting the donor roll.

As shown in FIG. 3, a continuous wire may be wrapped around fingers 108 of frame of 98 to form a plurality of spaced substantially parallel electrode wires positioned at an acute angle A relative to the longitudinal axis 96 of donor roller 40. Each of these electrode wires 42 contacts donor roller 40 in contact area 102.

In recapitulation, it is evident that that the developer unit of the present invention includes a plurality of electrode wires positioned closely adjacent and in contact with a portion of the exterior surface of a donor roll and in the gap between the donor roll and the photoconductive surface. The electrode wires are positioned at an acute angle relative to the longitudinal axis of the donor roll. As the donor roll rotates, debris trapped by the electrode wires is moved away from the toner powder cloud so as to enhance development and minimize streaks by the debris. An AC voltage is applied to the electrode wires to detach toner particles from the donor roll so that a toner powder cloud is formed in the space between the photoconductive surface and the donor roll. Detached toner particles from the toner powder cloud are attracted to the latent image recorded on the photoconductive surface to develop the latent image.

It is, therefore, apparent that there has been provided in accordance with the present invention a development system that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended claims.

We claim:

1. An apparatus for developing in a development zone a latent image recorded on a surface, including:

a housing defining a chamber storing at least a supply of toner therein;

a donor roll disposed of at least partially in the chamber of said housing and spaced from the surface, said donor roll being adapted to rotate about a longitudinal axis to transport toner to the development zone in a region opposed from the surface; and an elongated electrode mounted stationarily in the development zone and extending in a direction transverse to the longitudinal axis, said electrode being positioned in the development zone and spaced between the surface and said donor roll, said electrode being electrically biased to detach toner from said donor roll so as to form a toner powder cloud in the development zone with detached toner from the toner cloud developing the latent image.

2. An apparatus accordingly to claim 1, wherein said electrode includes a plurality of elongated wires with adjacent wires being spaced from and substantially parallel to one another.

3. An apparatus according to claim 2, further including means for supporting said plurality of wires at a preselected tension.

4. An apparatus according to claim 3, wherein said plurality of wires contact said donor roll in the space between said donor roll and the surface.

5. An apparatus according to claim 4, further including means, disposed in the chamber of said housing, for transporting toner to said donor roll.

6. An apparatus according to claim 5, wherein said transporting means includes a transport roll generating a magnetic field to attract carrier having toner adhering triboelectrically thereto.

7. An electrophotographic printing machine of the type having a latent image recorded on a photoconductive member, developed in a development zone and transferred to a sheet, wherein the improvement includes:

a housing defining a chamber storing at least a supply of toner therein;

a donor roll disposed of at least partially in the chamber of said housing and spaced from the photoconductive member, said donor roll being adapted to rotate about a longitudinal axis to transport toner to a region opposed from the photoconductive member; and an elongated electrode mounted stationarily in the development zone and extending in a direction transverse to the longitudinal axis, said electrode being positioned in the development zone and spaced between the photoconductive member and said donor roll, said electrode being electrically biased to detach toner from said donor roll so as to form a toner powder cloud in the development zone with the detached toner from the toner powder cloud developing the latent image.

8. A printing machine according to claim 7, wherein said electrode includes a plurality of elongated wires with adjacent wires being spaced from substantially parallel to one another.

9. A printing machine according to claim 8, further including means for supporting said plurality of wires at a preselected tension.

10. A printing machine according to claim 9, wherein said plurality of wires contact said donor roll in the space between said donor roll and the photoconductive member.

11. A printing machine according to claim 10, further including means disposed in the chamber of said housing, for transporting toner to said donor roll.

12. A printing machine according claim 11, wherein said transporting means includes a transport roll generating a magnetic field to attract carrier having toner adhering triboelectrically thereto.

* * * * *